United States Patent [19]

Maass

[11] Patent Number: 4,461,421

[45] Date of Patent: Jul. 24, 1984

[54] RAILROAD CROSSING STRUCTURE

[75] Inventor: William D. Maass, Waterloo, Canada

[73] Assignee: The B. F. Goodrich Company, New York, N.Y.

[21] Appl. No.: 404,015

[22] Filed: Aug. 2, 1982

[30] Foreign Application Priority Data

Jun. 2, 1982 [CA] Canada ..... 404283

[51] Int. Cl.[3] ..... E01C 9/04

[52] U.S. Cl. ..... 238/8; 238/381

[58] Field of Search ..... 238/6, 8, 9, 379, 380, 238/381; 403/37, 38, 39, 47, 49

[56] References Cited

U.S. PATENT DOCUMENTS

| | | | |
|---|---|---|---|
| 1,598,584 | 8/1926 | Jones | 238/8 |
| 1,649,191 | 11/1927 | Rogers | 238/9 |
| 1,649,192 | 11/1927 | Rogers | 238/9 |
| 2,042,805 | 6/1936 | Rose | 238/8 |
| 2,828,079 | 3/1958 | Rennels | 238/8 |
| 2,828,080 | 3/1958 | Rennels | 238/8 |
| 2,835,451 | 5/1958 | Goulding, Jr. | 238/8 |
| 3,465,963 | 9/1969 | Caillet et al. | 238/8 |
| 3,469,783 | 9/1969 | Uralli et al. | 238/8 |
| 3,843,051 | 10/1974 | Whitlock | 238/8 |
| 4,093,120 | 6/1978 | Canfield | 238/8 |
| 4,117,977 | 10/1978 | Whitlock | 238/8 |
| 4,267,969 | 5/1981 | Hales et al. | 238/8 |
| 4,279,532 | 7/1981 | Miller et al. | 238/8 X |

FOREIGN PATENT DOCUMENTS

| | | | |
|---|---|---|---|
| 1908832 | 1/1971 | Fed. Rep. of Germany | 238/8 |

*Primary Examiner*—Randolph Reese

*Attorney, Agent, or Firm*—Joseph Januszkiewicz

[57] ABSTRACT

The present invention contemplates a resilient pad mounted on the outside adjacent portion of a rail having sealing engagement with the rail along its base, the head and the interconnecting web of the rail with compression chambers located within the pad to permit the resiliency of the pad to cooperate with the movement of the rail in its vertical displacement as well as other movements imparted thereto by the passage of trains, thereover while maintaining a sealing contact with the rail to prevent water collecting along the rail and other foreign matter to minimize maintenance.

7 Claims, 3 Drawing Figures

RAILROAD CROSSING STRUCTURE

BACKGROUND OF THE INVENTION

This invention relates to a railroad crossing structure and more particularly to a new and improved railroad crossing structure employing resilient units adjacent to the railroad track.

Considerable effort has been made to improve railroad crossing structures to reduce the maintenance and upkeep required thereon. One of the principal problems of railroad crossing is that their structure tend to deteriorate in a relatively short time requiring considerable expenditure of time and money to repair such structure. Of particular concern is that during the winter months, the repairs made can only be temporary which are often unsatisfactory. An additional problem is that water or moisture accumulate in and around the rails and ties and through the repeated process of freezing and thawing breaks up the pavement. Some installations have approached the problem by employing extensive flexible plates that substantially cover the entire area between adjacent tracks. These are costly installations. The present invention employs longitudinal resilient pads or strips that effectively seal the adjacent areas of the railroad tracks from water and other foreign matters while permitting the use of conventional material between such adjacent rails thereby minimizing cost. In addition the resilient pad effectively seals the rail to prevent the damage caused by refreezing of water since it effectively seals out such water.

SUMMARY OF THE INVENTION

The present invention is directed to a railroad crossing structure that has a resilient longitudinally extending pad located along the outside portion of the rail in sealing engagement therewith. The resilient pad has a bottom surface that is contoured to the surface of the base of the rail and in engagement therewith, a side surface that abuttingly and sealing engages the web of the rail, and an upper corrugated surface that is substantially flush with the top of the rail. The pad has compression chambers that provide for the resiliency thereof. Selectively a similarly resilient pad or rigid I-shaped beam structure is mounted adjacent to the rail on the side opposite the first pad to accommodate the flange of the railroad car's wheel while sealing the rail.

DETAILED DESCRIPTION

Figure 1:
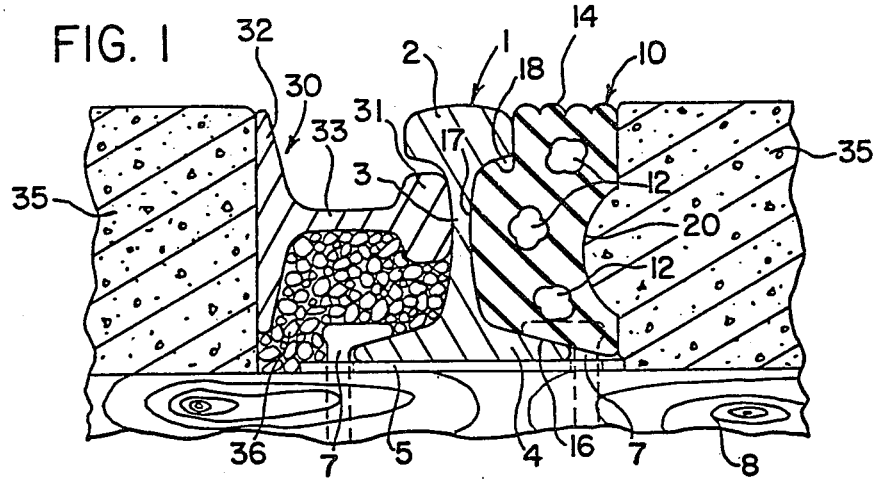
FIG. 1 is a cross-sectional view of a railroad track showing a resilient seal and a portion of a railroad tie with an outside sealing member.

Referring to the drawings wherein like reference numerals designate like or corresponding parts throughout the several views, there is shown in FIG. 1 a rail 1 having head 2, an intermediate web portion 3 and a base 4 suitably resting on a plate 5 and secured by rail spikes 7 into railroad cross ties 8. Other rail supporting means may be employed.

In viewing FIG. 1, the area to the left thereof is referred to as the inside since it depicts that the parallel rail for rail 1 is to the left thereof and that the area to the right thereof is the outside area.

Mounted to the outside of the rail is a longitudinally extending block of a resilient pad, or slab of material 10 made from an elastomer such as natural rubber, or a synthetic material which is resistant to corrosion as well as abrasion, as for example butyl rubber, EPDM rubber, and the like. Pad or slab 10 has a plurality of bores 12 extending longitudinally therethrough. Such bores acts as compression chambers accommodating the changing shape effected on the resilient slab from outside forces. The upper running surface of the slab 10 has a corrugated surface 14 substantially on the same planar surface as the top of the rail 1. The lower surface of slab 10 has an inclined surface 16 that snugly fits the countour of the base 4 of rail 1, however extending laterally downward beyond the base to provide a firm contact with the plate 5. Such contour of the lower surface of slab 10 is complimentary to that of the bottom portion of the rail which contour can vary, be it horizontal or inclined. The one side surface 17 of the flexible slab 10 is a generally convex shape paralleling that of the contour of the rail such as to merge with the bottom portion of the slab that follows the contour of the base 4 as seen in FIG. 1. The uppermost portion of such one side surface 17 is generally planar and in abutting contact with the head 2 of the rail 1. The portion of side surface 17 between the planar surface and the convex side portion is recessed as at 18. This construction of the slab 10 provides a compression chamber in recess 18 in cooperation with the head 2 and web 3. The side 20 of slab 10 opposite that of side 17 has an upper planar surface adjacent the top surface 14 and a lower planar surface adjacent the bottom surface of the slab. Side 20 intermediate the upper and lower planar surfaces of slab 10 is arcuate shaped to provide a recess within which asphalt or other fill material which is used holds the slab 10 in position against the rail. The slab 10 adjacent to rail 1 is relatively narrow and an asphalt or other road surface construction material is formed snugly against the outside surface of side 20 thereof so as to form an unbroken surface between the resilient slab 10 and the road surface of the crossing that has substantial depth and holds the slab 10 in a fixed position relative to rail 1.

Mounted on the opposite side of slab 10 is a horizontally disposed rail 30 having a head 31, flanged base 32 and an interconnecting web 33. Asphalt 35, paving material or some other fiber material or fill material is compacted between the rails 1 and the flanged bases 32 on each side of the rails 1. Gravel 36 may be compacted below the web 33 to provide drainage. The head 31 of the rail 30 abuttingly contacts the web 3 of rail 1 and is closely adjacent the head 2 of rail 1 to provide a clearance space for the movement of the flange of the railroad wheels. The flanged base 32 has its uppermost edge substantially parallel with the top surface of rail 1 such that the compacted fill material between the rails 1 is held at the same level as the rails to facilitate the safe movement of traffic transverse to the rails at such railroad crossings. The interconnecting web 33 is substantially horizontal. The horizontally disposed rail 30 is shown of smaller dimension than the rail 1 although other sizes are contemplated. Further, in lieu of a rail 30 other configuration may be used, such as an I-beam with legs corresponding to the length of rail 30 to permit the unobstructed rolling of the railroad wheel's flange.

Figure 2:
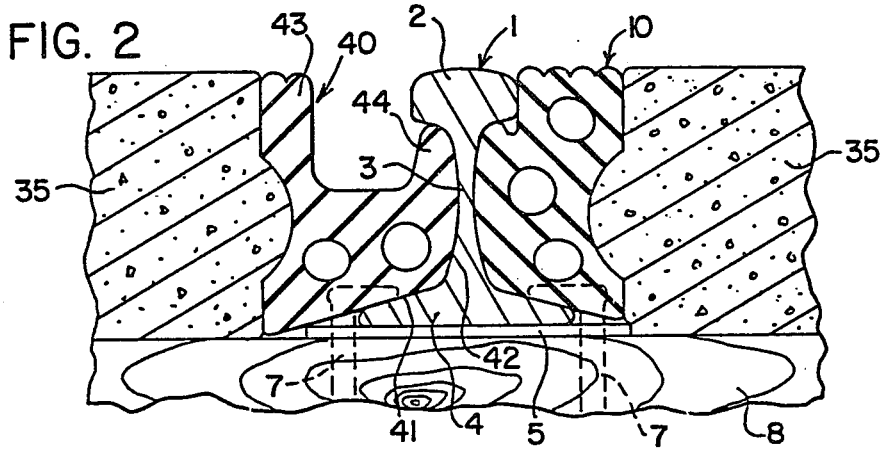
FIG. 2 is a cross-sectional view of a rail and seal unit of a modified form of the invention.
Figure 3:
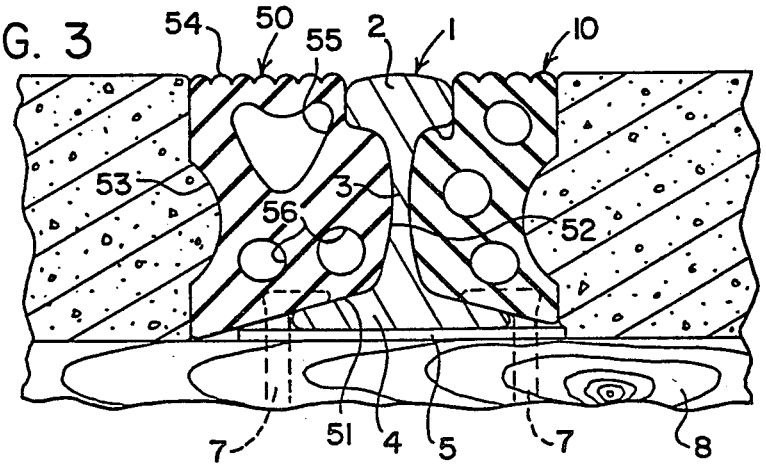
FIG. 3 is a cross-sectional view of a rail and a further modified form of a seal unit.

A modification of the above described invention is shown in FIGS. 2 and 3 wherein the rail 1 and resilient slab 10 are identical to that described in FIG. 1. However in lieu of the rigid rail 30 a resilient longitudinally extending pad 40 or 50 is substituted as per FIGS. 2 and 3 respectively.

Resilient pad 40 is contoured similarly to that of pad 10 having a plurality of longitudinally extending bores, an arcuately shaped bottom surface 41, a slightly arcuately contoured side surface 42 except that its upper portion is generally U-shaped, having upwardly extending leg portions 43 and 44. Leg portion 44 terminates into abutting frictional contact with the underneath portion of head 2 of rail 1 while leg portion 43 extends upwardly to a position that is on the same horizontal plane as the top surface of rail 1 thus providing a recess on the inside surface of rail 1 to accommodate the unobstructed movement of the flanged wheel of a railroad car.

Resilient pad 50 is contoured similarly to that of pad 10 having a plurality of longitudinally extending bores 56, an arcuately shaped bottom surface 51, an arcuately contoured side surface 52, a recess 53 on other side surface, a top corrugated surface 54, however, having a relative large triangular shaped longitudinally extending bore 55 compared to bores 56 or 12. Other configurations of bore 55 are contemplated, however, it being advantageous to have such bore of a large size to permit deflection to accommodate the flange of a rail wheel. Bore 55 is located along the upper portion of pad 50 to provide sufficient resiliency to accommodate the unobstructed movement of the flanged wheel of a railroad car which will deflect downwardly that portion of pad 50 that is adjacent to the head 2 of rail 1. The other difference in pad 50 to pad 10 is that pad 50 (as well as pad 40) is of greater width to provide stability to the pad in its functioning to seal the area adjacent to the rail yet provide a smooth passage for vehicles across while reducing the cost of maintaining the crossing structure over a prolonged period under adverse weather and traffic conditions.

It will be apparent that, although a specific embodiment and certain modifications of the invention have been described in detail, the invention is not limited to the specifically illustrated and described inventions since variations may be made without departing from the principles of the invention.

I claim:

1. A rail crossing structure comprising a supporting means for supporting the rail crossing structure; at least a pair of spaced rails mounted on said supporting means; each of said rails having a head, a base and an intermediate web interconnecting said base and said head; a longitudinally extending resilient pad mounted on one side of each of said rails; each of said pads having a plurality of bores extending longitudinally therethrough; each of said pads having an upper surface, a lower surface and two contoured side surfaces; said lower surfaces sealingly abuttingly contacting said base of said rails; said upper surfaces lying in the same general plane of the top of said rails; one of said sides of each of said pads having a major portion thereof in sealing and abutting contact with said intermediate web of said rail; the upper portion of said one side of each of said pads being generally planar and in abutting contact with said head of said rails; and the juncture of each said upper planar portions of said pads and said major portion of said one side of said pads in contact with said intermediate web being recessed to define a longitudinally extending channel with an upwardly disposed lip and a compression chamber in cooperation with said rail.

2. A rail crossing structure as set forth in claim 1 wherein a member is mounted on the other side of each of said rails to facilitate the movement of a flange wheel over said rail while sealing at least a portion of said other side of said rail from water and contaminants; each of said members is a second longitudinally extending resilient pad; each of said second pads having a plurality of bores extending longitudinally therethrough; one of said bores in said second pad being greater in cross-sectional area than the other ones of said bores in said second pad to provide greater resiliency along the upper end adjacent said head of said rail; and each of said second pads is in full abutting contact with said rail along said base, said intermediate web and said head to effectively seal said rail from water and contaminants.

3. A rail crossing structure as set forth in claim 2 wherein each of said second pads has a longitudinally extending recess along one of its sides opposite the side abutting said web to provide for the anchoring of said second pad by fill disposed between said spaced rails.

4. A rail crossing structure as set forth in claim 1 wherein a second resilient longitudinally extending pad is mounted on the other side of each of said rails to facilitate the movement of a flanged wheel over said rail while sealing at least a portion of said other side of said rail from water and contaminants; each of said second pads having a plurality of bores extending longitudinally therethrough; each of said second pads having an upper cross-sectional shape that is U-shaped with spaced upwardly extending leg portions defining a channel therebetween for the passage of water; one of said leg portions terminating adjacent said web and abutting said head of said rail; the other one of said leg portions extending upwardly to substantially the same level as the top of said rail.

5. A railroad crossing wherein at least a pair of rails is mounted on spaced ties wherein said ties extend transversely to said rails; each rail having a head, a base and an interconnecting web; each of said rails having an inside side portion that face each other and outside side portions that face away from each other; a longitudinally extending resilient pad mounted adjacent to said outside portion of one of said rails; said longitudinally extending resilient pad having an upper portion, a lower portion and an intermediate portion; said resilient pad having two spaced longitudinally extending sides; each side of said resilient pad extends along the full length of said pad; said lower portion of said resilient pad frictionally abuts and rests on said base; one of said sides of said resilient pad abuts said interconnecting web and merges with said lower portion of said pad that abuts said rail base; said upper portion of said resilient pad having a planar surface that frictionally abuts said head on said outside side portion of said one rail; and said one side of said resilient pad having a longitudinally extending concave recess at the juncture of said planar surface and said one side to define an upwardly extending lip and a compression chamber between said pad and said one rail; the remaining side of said resilient pad that is opposite said one side is recessed along its intermediate portion to provide a means for frictional engagement with fill in the area outside of said rail and pad to secure said resilient pad in its position at such railroad crossing.

6. A railroad crossing as set forth in claim 5 wherein a second resilient pad is mounted on said inside side portion of each of said rails; and each of said second resilient pads having a side portion and a bottom portion that abuttingly contacts said intermediate web and said base of said rail respectively; each of said second resilient pads having a generally U-shaped upper contour defining two leg portions with a channel therebetween; one of said leg portions terminating under said head of said rail and sealingly engaging said web of said rail; the other leg portion terminating along a horizontal plane that is even with the top surface of said rail thereby defining a recess to accommodate the flange of a rail wheel.

7. A railroad crossing as set forth in claim 5 wherein a second resilient pad is mounted on said inside side portion of said one rail; said second pad having a side portion and a bottom portion that abuttingly contacts said intermediate web and said base of said one rail respectively; said second resilient pad having a top surface that is coextensive with the top surface of said one rail; said second pad having a plurality of longitudinally extending bores therethrough; and one of said bores in said second pad being substantially larger in cross-sectional area than all other of said bores and located adjacent the upper surface portion of said second pad to permit the compression of said upper portion to accommodate the flange of a rail wheel.

* * * * *